US008210376B2

(12) United States Patent
Robinson

(10) Patent No.: US 8,210,376 B2
(45) Date of Patent: Jul. 3, 2012

(54) CHILD-RESISTANT PACKAGE HAVING A PLASTIC CONTAINER WITH A BLOW-MOLDED NECK FINISH, AND A CONTAINER AND CLOSURE FOR SUCH A PACKAGE

(75) Inventor: Philip J. Robinson, Sylvania, OH (US)

(73) Assignee: Berry Plastics Corporation, Evansville, IN (US)

( * ) Notice: Subject to any disclaimer, the term of this patent is extended or adjusted under 35 U.S.C. 154(b) by 1633 days.

(21) Appl. No.: 11/218,863

(22) Filed: Sep. 2, 2005

(65) Prior Publication Data

US 2007/0051692 A1 Mar. 8, 2007

(51) Int. Cl.
*B65D 41/04* (2006.01)
*B65D 55/02* (2006.01)

(52) U.S. Cl. ..... 215/330; 215/217; 215/221; 215/44; 215/341

(58) Field of Classification Search ..... 215/221, 215/225, 217, 334, 341–344, 44, 216, 218–220, 215/330, 331
See application file for complete search history.

(56) References Cited

U.S. PATENT DOCUMENTS 3,857,508 A * 12/1974 LaBarge et al. ..... 215/221
3,941,268 A 3/1976 Owens et al.
3,944,101 A 3/1976 Landen et al.
4,105,132 A 8/1978 Keeler
4,134,513 A 1/1979 Mumford
4,213,534 A 7/1980 Montgomery
4,383,618 A 5/1983 Dougherty
4,413,743 A 11/1983 Summers
4,436,211 A 3/1984 Gach
4,630,743 A 12/1986 Wright
(Continued)

FOREIGN PATENT DOCUMENTS

GB 2164 325 A 3/1986

OTHER PUBLICATIONS

Anonymous Document (6907 Releasable Locking Mechanism) 14pgs.

*Primary Examiner* — Robin Hylton
(74) *Attorney, Agent, or Firm* — Barnes & Thornburg LLP

(57) ABSTRACT

A child-resistant package includes a plastic container having a blow-molded neck finish with an end, at least one external thread, an arcuate part-circumferential ledge adjacent to the neck finish and a plurality of angularly spaced ratchet teeth on the ledge. A closure has at least one skirt, at least one internal thread on the skirt, at least one flexible resilient ratchet finger extending radially inwardly from the skirt at an angle to the skirt, and a seal element within the skirt for sealing engagement with the end of the container neck finish. Threading of the closure onto the container neck finish brings the ratchet finger into engagement with the ratchet teeth. The array of ratchet teeth and the seal element are such as to accommodate tolerance variations in the blow-molded neck finish while maintaining a seal and child-resistance capability at the neck finish. In an exemplary embodiment of the disclosure, there are a pair of angularly spaced ratchet fingers on the skirt, with the array of ratchet teeth, the seal element and the angular spacing between the ratchet fingers accommodating tolerance variations in the blow-molded neck finish. The closure preferably is a dual-wall closure having an internal skirt with the internal thread and an external skirt with the ratchet fingers.

19 Claims, 5 Drawing Sheets

U.S. PATENT DOCUMENTS 4,667,836 A 5/1987 McLaren
5,238,130 A * 8/1993 Marques et al. ..... 215/216
5,381,911 A * 1/1995 Teicher et al. ..... 215/216
5,685,204 A * 11/1997 Braun ..... 81/63.1
5,836,466 A 11/1998 Briere et al.
5,884,787 A 3/1999 Quintard et al.
5,915,576 A 6/1999 Robinson
5,921,417 A 7/1999 Mull
5,927,526 A * 7/1999 Herr ..... 215/216
6,047,840 A 4/2000 Moore et al.
6,102,223 A 8/2000 Montgomery
6,152,315 A 11/2000 Montgomery
6,343,705 B1 2/2002 Minnette
6,561,370 B1 5/2003 Escobar-Harrity
6,871,752 B2 * 3/2005 Montgomery ..... 215/219
2004/0222181 A1 11/2004 Biesecker et al.

* cited by examiner

CHILD-RESISTANT PACKAGE HAVING A PLASTIC CONTAINER WITH A BLOW-MOLDED NECK FINISH, AND A CONTAINER AND CLOSURE FOR SUCH A PACKAGE

The present disclosure relates to child-resistant packages, closures and containers, and more particularly to a squeeze-and-turn closure for a plastic container having a blow-molded neck finish.

BACKGROUND AND SUMMARY OF THE DISCLOSURE

Squeeze-and-turn child-resistant packages typically have one or more internal lock elements on the closure skirt that engage one or more external lock elements on the container neck finish or the container shoulder. To remove the closure, the closure skirt is diametrically squeezed at an orientation 90° to the lock elements so that the skirt ovalizes, the internal lock elements on the skirt clear the external lock elements on the container and the closure can be unthreaded. U.S. Pat. No. 5,915,576 discloses a squeeze-and-turn child-resistant package of this type. In plastic containers for this type of package, the container neck finish typically is of injection molded construction, in which fairly tight manufacturing tolerances can be maintained. In containers having blow-molded neck finishes, however, the tolerances on the neck finish must be fairly broad, so that the child-resistance mechanism must be able to operate over a fairly substantial angle of rotation of the closure with respect to the container neck finish. It is a general object of the present disclosure to provide such a closure, to provide a container for use with such a closure and/or to provide a squeeze-and-turn child-resistant package embodying such a closure and container.

The present disclosure embodies a number of aspects that can be implemented separately from or in combination with each other.

A child-resistant package in accordance with one aspect of the present disclosure includes a plastic container having a blow-molded neck finish with an end, at least one external thread, an arcuate part-circumferential ledge adjacent to the neck finish and a plurality of angularly spaced ratchet teeth on the ledge. A closure has at least one skirt, at least one internal thread on the skirt, at least one flexible resilient ratchet finger extending radially inwardly from the skirt at an angle to the skirt, and a seal element within the skirt for sealing engagement with the end of the container neck finish. Threading of the closure onto the container neck finish brings the ratchet finger into engagement with the ratchet teeth. The array of ratchet teeth and the seal element are such as to accommodate tolerance variations in the blow-molded neck finish while maintaining a seal and child-resistance capability at the neck finish. In an exemplary embodiment of the disclosure, there are a pair of angularly spaced ratchet fingers on the skirt, with the array of ratchet teeth, the seal element and the angular spacing between the ratchet fingers accommodating tolerance variations in the blow-molded neck finish. The closure preferably is a dual-wall closure having an internal skirt with the internal thread and an external skirt with the ratchet fingers.

BRIEF DESCRIPTION OF THE DRAWINGS

The disclosure, together with additional objects, features, advantages and aspects thereof, will best be understood from the following description, the appended claims and the accompanying drawings in which:

DETAILED DESCRIPTION OF PREFERRED EMBODIMENTS

Figure 1:
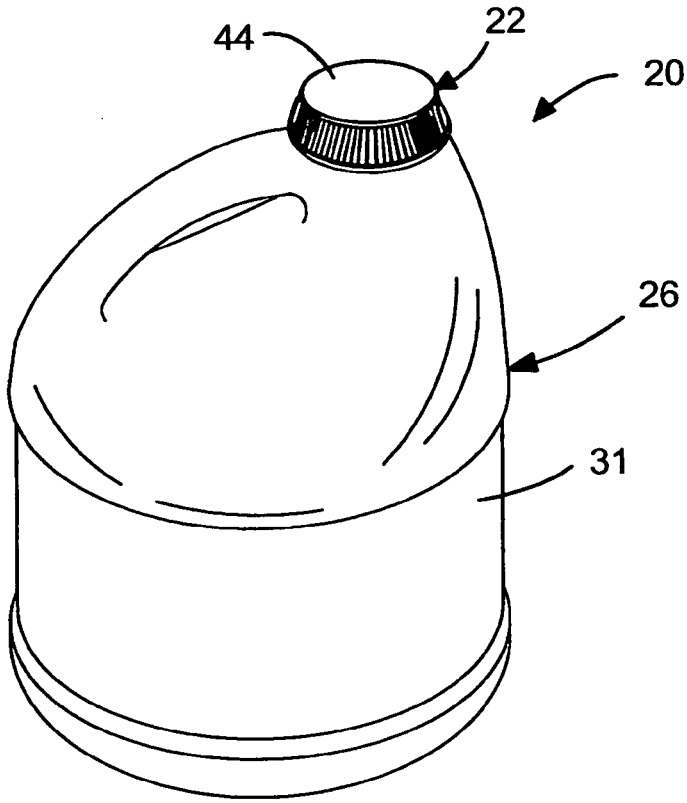
FIG. 1 is a perspective view of a child-resistant package in accordance with an exemplary embodiment of the disclosure.
Figure 2:
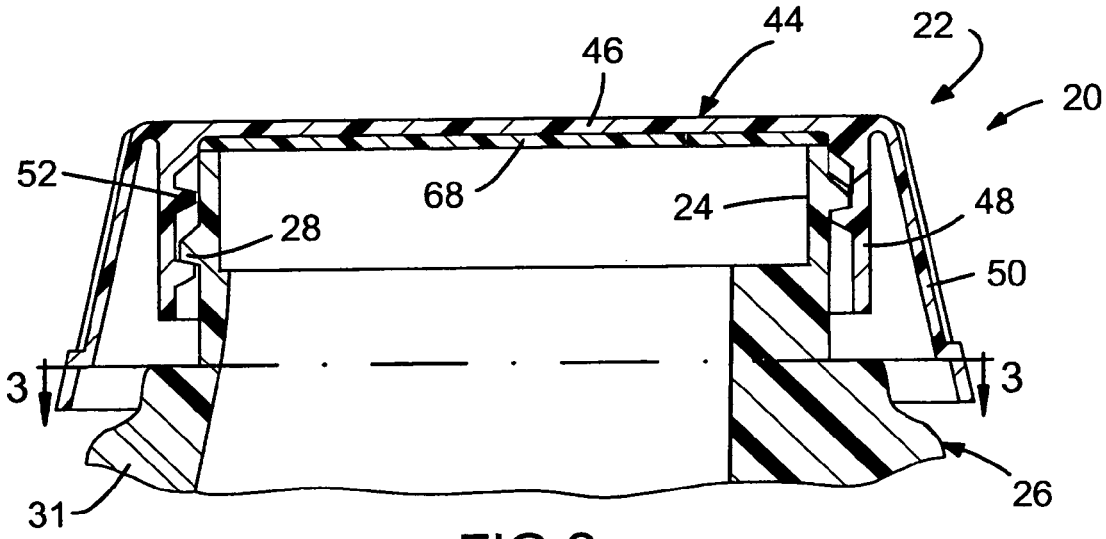
FIG. 2 is a fragmentary sectional view of the neck finish and closure in the package of FIG. 1.
Figure 3:
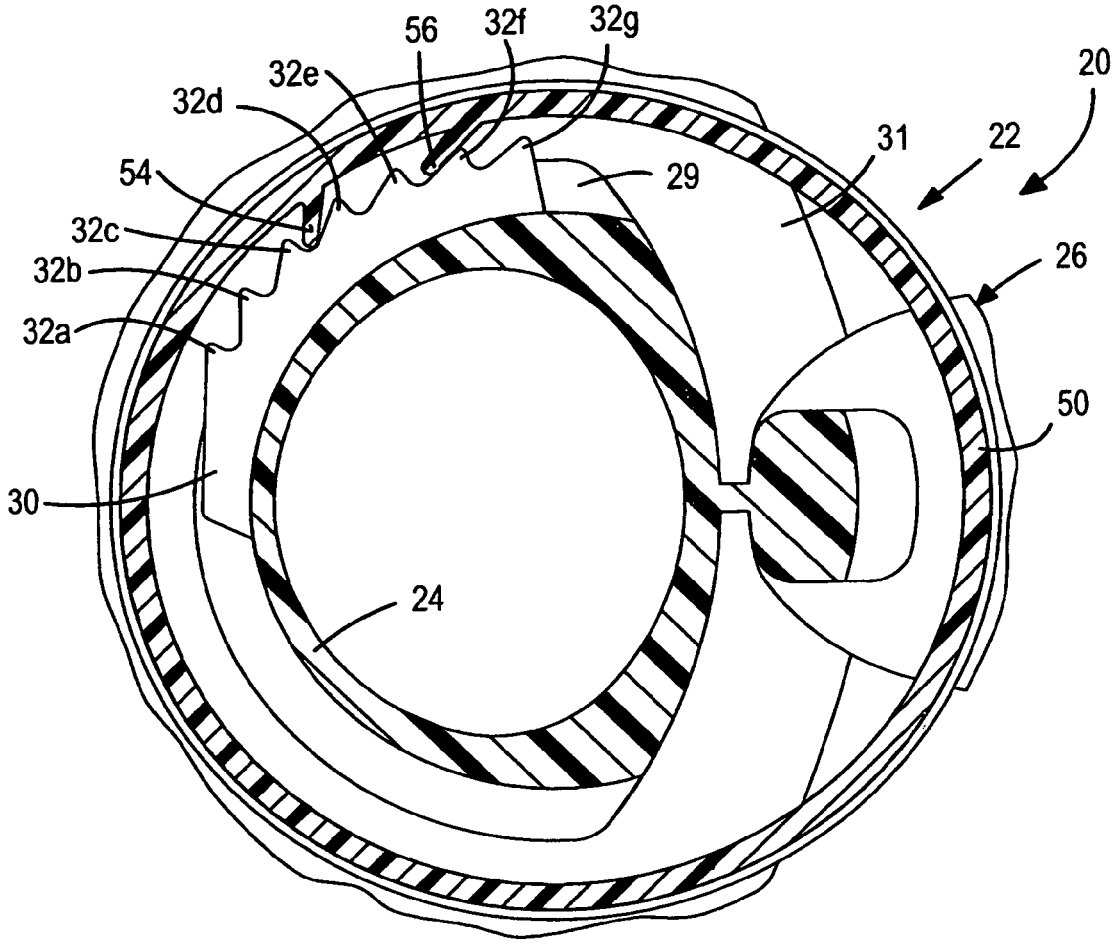
FIG. 3 is a sectional view taken substantially along the line 3-3 in FIG. 2.
Figure 4:
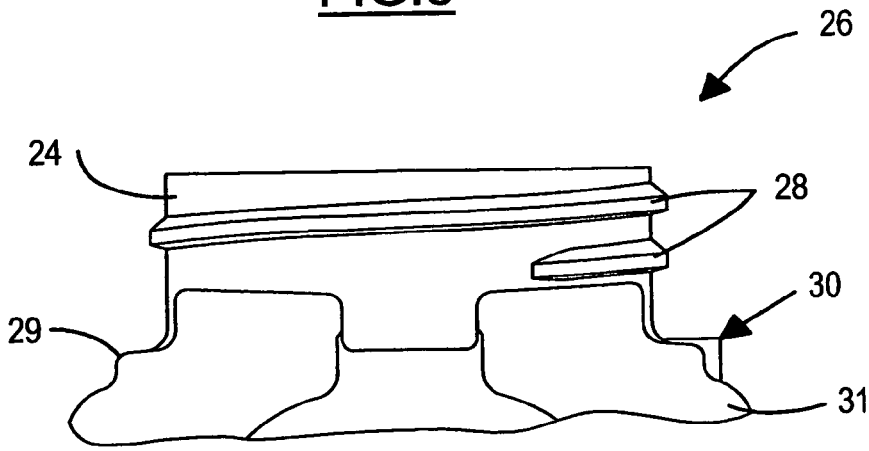
FIG. 4 is a fragmentary elevational view of the container in the package of FIGS. 1-3.
Figure 5:
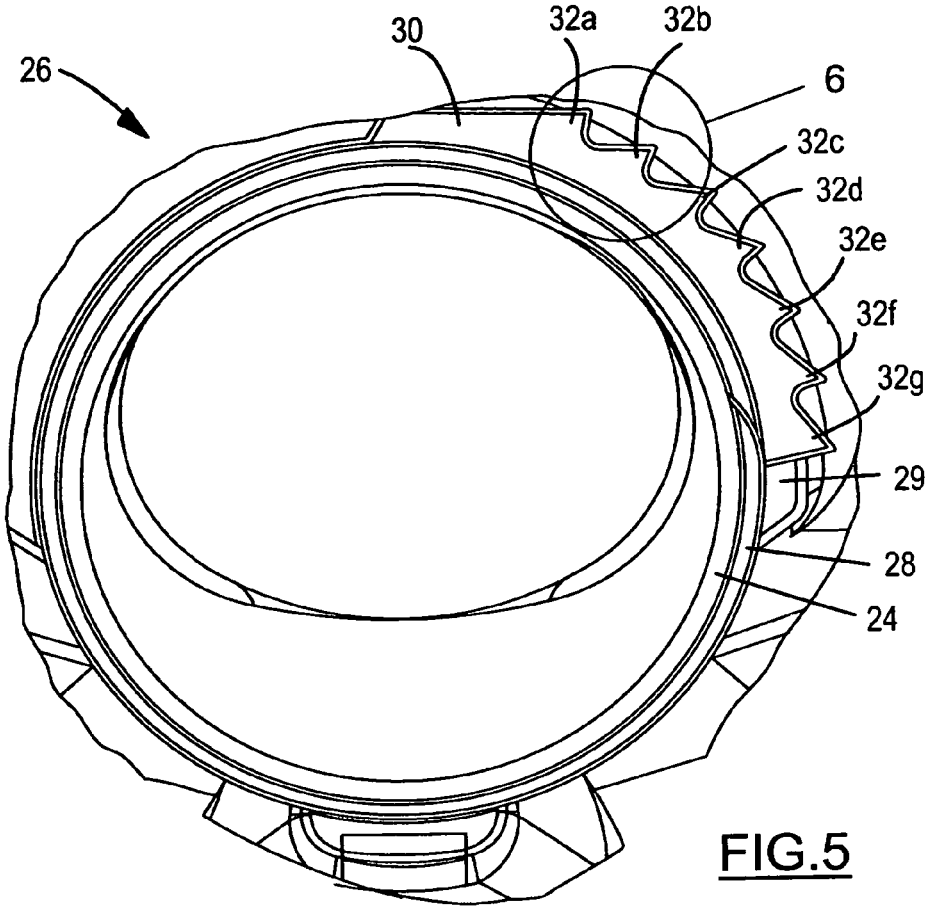
FIG. 5 is a top plan view of the container neck finish in FIG. 4.
Figure 6:
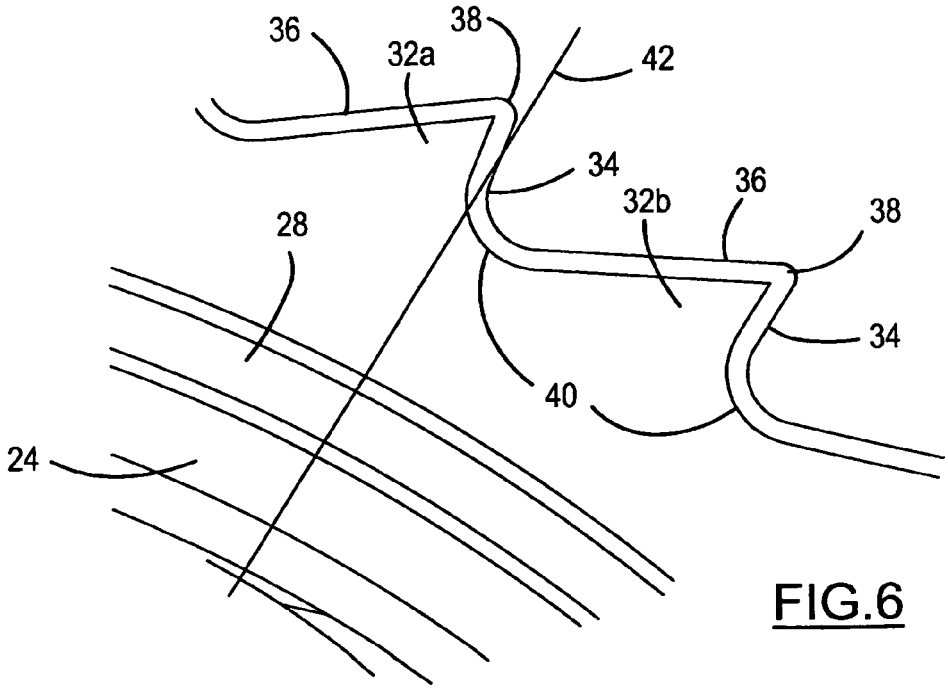
FIG. 6 is a fragmentary plan view on an enlarged scale of the portion of FIG. 5 within the area 6.
Figure 7:
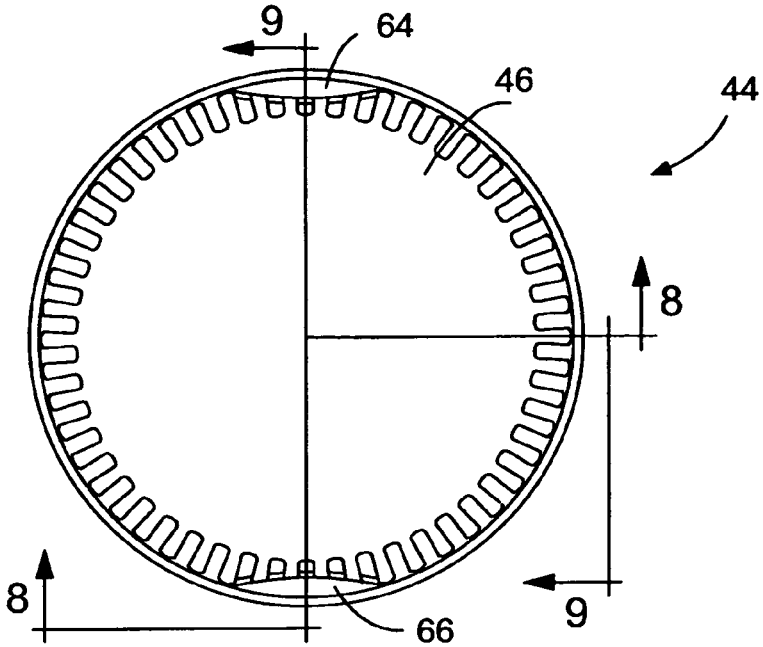
FIG. 7 is a top plan view of the closure shell in the package of FIGS. 1-2.

FIGS. 1-3 illustrate a child-resistant package 20 in accordance with an exemplary embodiment of the disclosure as including a closure 22 applied to the neck finish 24 of a container 26. Container 26, including neck finish 24, preferably is of blow-molded plastic construction. Container 26 is illustrated in greater detail in FIGS. 4-6. Container neck finish 24 is generally cylindrical and preferably has a single external thread 28. External thread 28 preferably is a continuous external thread, but could be discontinuous if desired. An arcuate part-circumferential ledge 30 is disposed adjacent to one side of neck finish 24 on a side of external thread 28 remote from the open end of the container neck finish. Ledge 30 can extend from neck finish 24 or from the shoulder 29 of the container body 31. A plurality of angularly spaced ratchet teeth extend radially outwardly from an external edge of ledge 30 on only one side of the neck finish 24. In the illustrated embodiment of the disclosure, there are seven ratchet teeth 32*a* through 32*g*, although a greater or lesser number of ratchet teeth could be employed. Each ratchet tooth has a clockwise-facing abutment face 34 (as viewed from above), a counterclockwise facing angulated cam surface 36, and radiused tips 38 and bases 40. The abutment faces 34 of the ratchet teeth are at open angles to diameters 42 (FIG. 6) through the container neck finish. These features not only allow blowing of thicker material into the tips of the ratchet teeth, but also provide a surface over which the ratchet fingers can ride when the closure is simultaneously squeezed and turned in the counterclockwise direction. The ratchet teeth preferably are at substantially uniform angular spacing from each other.

Figure 10:
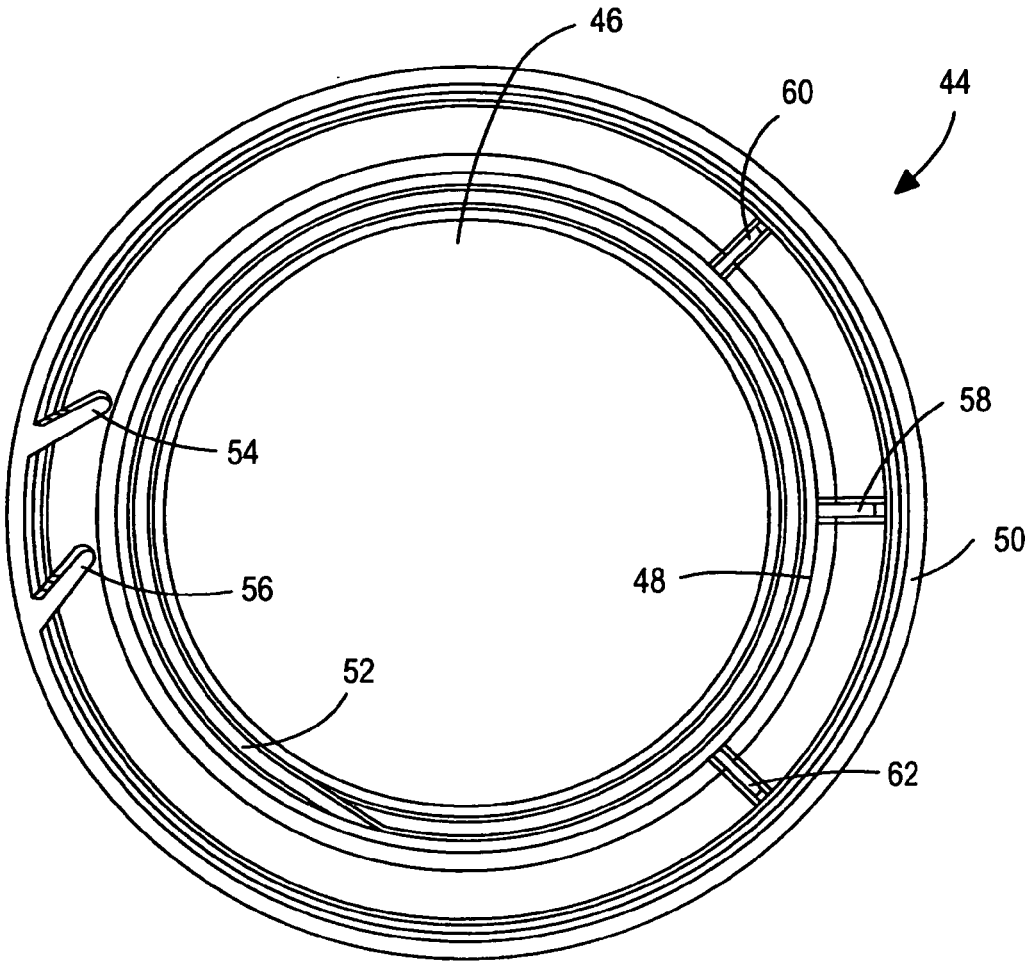
FIG. 10 is a bottom plan view of the closure shell in FIGS. 7-9.
Figure 11:
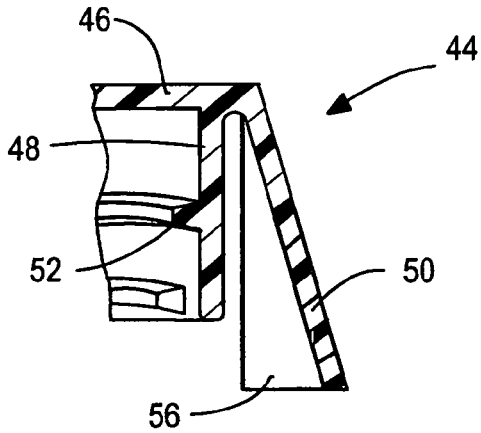
FIG. 11 is a fragmentary sectional view taken substantially along the line 11-11 in FIG. 9.

Closure 22 in FIGS. 1 and 2 includes a plastic closure shell 44 (FIGS. 7-10), preferably of one-piece injection or compression molded plastic construction. Closure shell 44 in the exemplary embodiment of the disclosure includes a base wall 46, an inner generally cylindrical skirt 48 and an outer skirt 50. An internal thread 52 is provided on inner skirt 48 for engagement with container neck finish external thread 28, as shown in FIG. 2. Outer skirt 50 is generally conical in the exemplary embodiment of the disclosure, but could be of any other suitable geometry. At least one flexible resilient ratchet wing or finger 54, and preferably a pair of angularly spaced flexible resilient ratchet wings or fingers 54, 56, extend radially inwardly from skirt 50 at a counterclockwise angle to the skirt as viewed from above in FIG. 3, or at a clockwise angle to the skirt as viewed from below in FIG. 10. With the preferred conical geometry of outer skirt 50, ratchet fingers 54, 56 preferably are generally triangular in side elevation in this exemplary embodiment, as best seen in FIG. 11. Ratchet fingers 54, 56 could be of other geometries. Ratchet fingers 54, 56 are integrally connected to outer skirt 50, but preferably are not connected to inner skirt 48. The angular spacing between ratchet fingers 54, 56 preferably is such, as compared with the angular spacings between ratchet teeth 32*a*-32*g*, that fingers 54, 56 do not simultaneously engage abutment faces 34. The angular spacing between the ratchet fingers preferably is a non-integral multiple of the angular spacing between the ratchet teeth.

Figure 8:
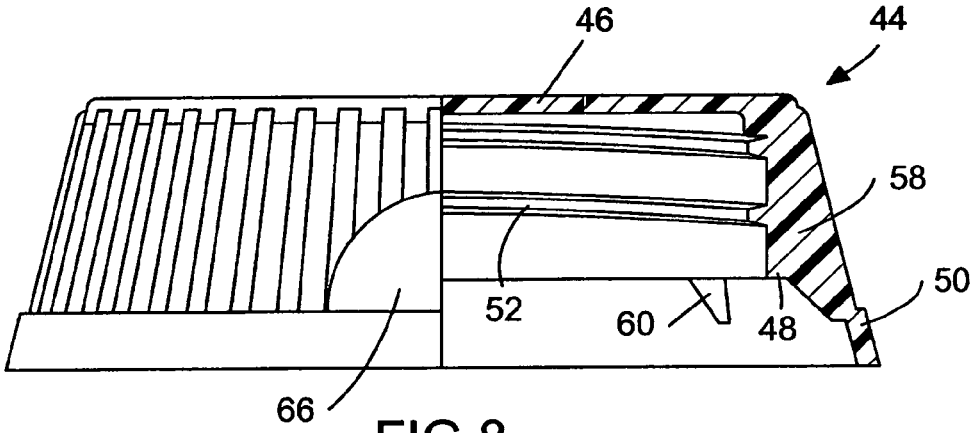
FIG. 8 is a sectional view taken substantially along the line 8-8 in FIG. 7.
Figure 9:
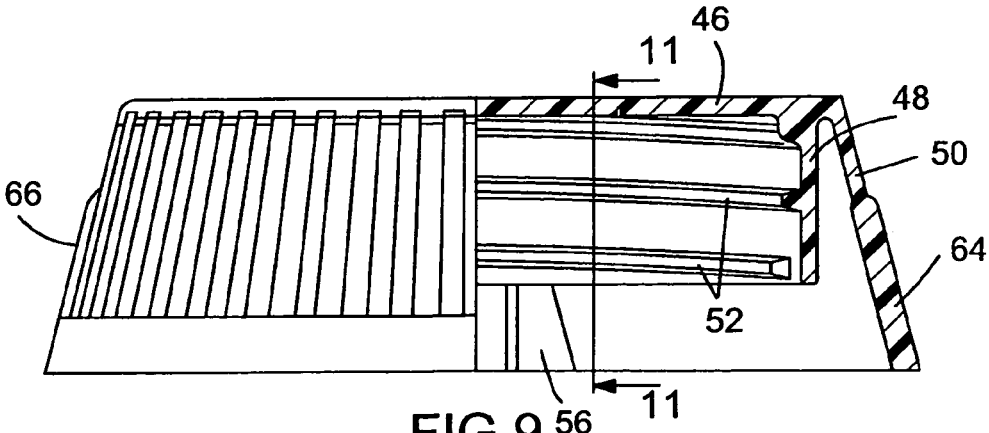
FIG. 9 is a sectional view taken substantially along the line 9-9 in FIG. 7.

In the exemplary embodiment of the disclosure, at least one web or rib 58, and preferably a plurality of angularly spaced webs or ribs 58, 60, 62, are provided on the inside surface of skirt 50 in an area diametrically opposed to ratchet fingers 54, 56. Ribs 58-62 extend from the inside surface of outer skirt 50 to the outside surface of inner skirt 48 and integrally connect the inner and outer skirts, as best seen in FIGS. 8 and 10. Diametrically opposed finger pads 64, 66 preferably are provided on the external surface of outer skirt 50. Finger pads 64, 66 are diametrically opposed to each other and at an angle of 90° to a diameter that extends between ratchet fingers 54, 56 and ribs 58-62. A seal element 68 (FIG. 2) is provided on closure 22 against base wall 46 within inner skirt 48. Seal element 68 engages the open end of the container neck finish for sealing the package. Seal element 68 is illustrated in FIG. 2 as a liner disk, but could be an annular gasket, a plug seal of the type disclosed in U.S. Pat. No. 4,134,513 or 6,112,921, a linerless seal of the type disclosed in U.S. Pat. Nos. 4,322,009, 5,320,236 or 6,874,648, or any other suitable type of seal. What is important is that the seal element accommodate some slight angular movement of the closure with respect to the container neck finish while maintaining both the seal and child-resistance capability between the closure and the container. The material of the seal element can be of any suitable type.

As closure 22 is applied to container neck finish 24 by turning the closure in a clockwise direction as viewed from above, leading ratchet finger 56 will initially cam over leading ratchet tooth 32*a* and rest in the area behind ratchet tooth 32*a*. This represents one tolerance limit for application of the closure to the container neck finish. In the preferred embodiment of the disclosure having two ratchet fingers 54, 56 on closure 22, the opposing tolerance limit is achieved when trailing ratchet finger 54 cams over the trailing ratchet tooth 32*g* and rests in the area behind this trailing ratchet tooth. Spacings between the ratchet fingers and the ratchet teeth in the exemplary embodiment of the disclosure are such that the total angle between these tolerance limits is about 90°. This angle could be increased or decreased by varying the size of the ledge, the number of ratchet teeth and the number of ratchet fingers. The array of ratchet teeth 32*a*-32*g*, seal element 68 (FIG. 2) and the angular spacing between the ratchet fingers 54, 56 (when more than one ratchet finger is employed) are such as to accommodate tolerance variations in blow-molded neck finish 24 while maintaining a seal and child-resistance capability at the neck finish. The ratchet fingers seat at the bases of the ratchet teeth, so sharp edges are not required in the ratchet teeth. When it is desired to remove the closure, closure skirt 50 is squeezed at finger pads 64, 66. Ribs 58-62 (FIG. 10), when employed, stiffen closure skirt 50 in the area of the ribs, so that the distortion of the skirt caused by squeezing the closure skirt at the finger pads is maximized in the area of ratchet fingers 54, 56. When this distortion or ovalization is such that the ratchet fingers clear ratchet lugs 32*a*-32*g*, the closure can be unthreaded in the counterclockwise direction. Directions for opening the package can be molded, printed or otherwise provided on the external surface of closure base wall 46.

There thus have been disclosed a child-resistant package, and a closure and a container for such a package, that fully satisfy all of the objects and aims previously set forth. The disclosure has been presented in connection with an exemplary embodiment of the disclosure, and a number of modifications and variations have been discussed. For example, the exemplary embodiment of the disclosure has ratchet teeth 32*a*-32*g* on one side of the container neck finish, ratchet fingers 54, 56 on one side of the closure, and single threads on the closure and the neck finish. This embodiment has the advantages of providing about 360° of travel of the closure and substantial vertical travel per rotation of the closure, and of accommodating a standard closure where child-resistance is not desired. However, ratchet teeth could be provided on both sides of the neck finish, ratchet fingers on both sides of the closure, and double threads on the closure and the container. Other modifications and variations readily will suggest themselves to persons of ordinary skill in the art in view of the foregoing discussion. The disclosure is intended to embrace all such modifications and variations as fall within the spirit and broad scope of the appended claims.

The invention claimed is:

1. A child-resistant closure that includes an inner skirt, an outer skirt spaced radially outwardly from said inner skirt, an internal thread on said inner skirt, a pair of angularly spaced flexible resilient ratchet fingers extending radially inwardly from said outer skirt at an angle to said outer skirt on one side of said skirt, and at least one internal stiffening rib extending between said inner skirt and said outer skirt on another side of said skirt, and including external finger pads on said skirt diametrically opposed to each other at 90° spacing to a diameter that extends between said ratchet fingers and said at least one stiffening rib.

2. The child-resistant closure set forth in claim 1 wherein an internal stiffening rib is in an area diametrically opposed from said ratchet fingers.

3. The closure set forth in claim 1 including at least two angularly spaced internal stiffening ribs extending between said inner skirt and said outer skirt in an area diametrically opposed from said ratchet fingers.

4. A child-resistant package that includes:

a plastic container having a blow-molded neck finish with an end, at least one external thread, an arcuate part-circumferential ledge adjacent to said neck finish and a plurality of angularly spaced ratchet teeth on said ledge on only one side of said neck finish, and a plastic closure having at least one inner skirt, an outer skirt spaced radially outwardly from said inner skirt, at least one internal thread on said inner skirt, at least one flexible resilient ratchet finger extending radially inwardly from said outer skirt at an angle to said outer skirt on one side of said outer skirt, at least one internal stiffening rib on said outer skirt on another side of said outer skirt, and a seal element within said inner skirt for sealing engagement with said end of said container neck finish, threading of said closure onto said container neck finish bringing said ratchet finger into engagement with said ratchet teeth, said ratchet teeth and said seal element accommodating tolerance variations in said blow-molded neck finish while maintaining a seal and child-resistance capability at said neck finish.

5. The package set forth in claim 4 wherein said ratchet teeth are radiused at tips and bases of said teeth.

6. The package set forth in claim 5 wherein said ratchet teeth have clockwise-facing abutment faces at open angles to diameters through said neck finish.

7. The package set forth in claim 4 wherein said closure includes only a pair of angularly spaced ratchet fingers on said outer skirt, said array of ratchet teeth, said seal element and angular spacing between said ratchet fingers accommodating tolerance variations in said blow-molded neck finish while maintaining a seal and child-resistance capability at said neck finish.

8. The package set forth in claim 7 wherein said closure includes at least two angularly spaced internal stiffening ribs on said outer skirt diametrically opposed from said ratchet fingers.

9. The package set forth in claim 8 wherein angular spacing between said ratchet fingers is a non-integral multiple of angular spacing between said ratchet teeth.

10. The package set forth in claim 4 wherein said closure includes external finger pads on said outer skirt diametrically opposed to each other at 90° spacing to a diameter that extends between said ratchet fingers and said at least one stiffening rib.

11. The package set forth in claim 10 wherein said closure is a dual-wall closure having said inner skirt with said internal thread, and said outer skirt with said finger pads and said ratchet fingers, said at least one stiffening rib extending between said inner and outer skirts.

12. A child-resistant package that includes:

a container having a blow-molded neck finish with an end, a single external thread, an arcuate part-circumferential ledge adjacent to one side of said neck finish and a plurality of angularly spaced ratchet teeth on said ledge on only one side of said neck finish, and a closure having an inner skirt with a single internal thread, an outer skirt with a pair of angularly spaced flexible resilient ratchet fingers extending radially inwardly from said outer skirt at an angle to said outer skirt on one side of said skirt, at least one internal stiffening rib extending between said inner skirt and said outer skirt on another side of said skirt, and a seal element within said inner skirt for sealing engagement with said end of said container neck finish, threading of said closure onto said container neck finish bringing said ratchet fingers into engagement with said ratchet teeth, said ratchet teeth, said seal element and angular spacing between said ratchet fingers accommodating tolerance variations in said blow-molded neck finish while maintaining a seal and child-resistance capability at said neck finish.

13. The package set forth in claim 12 wherein said closure includes at least two angularly spaced internal stiffening ribs extending between said inner skirt and said outer skirt in an area diametrically opposed from said ratchet fingers.

14. The package set forth in claim 13 wherein said closure includes external finger pads on said outer skirt diametrically opposed to each other at 90° spacing to a diameter that extends between said ratchet fingers and said stiffening ribs.

15. The package set forth in claim 12 wherein said ratchet teeth are radiused at tips and bases of said teeth.

16. The package set forth in claim 15 wherein said ratchet teeth have clockwise-facing abutment faces at open angles to diameters through said neck finish.

17. The package set forth in claim 12 wherein angular spacing between said ratchet fingers is a non-integral multiple of angular spacing between said ratchet teeth.

18. The package set forth in claim 4 wherein at least one internal stiffening rib is in an area diametrically opposed from said at least one ratchet finger.

19. The package set forth in claim 12 wherein at least one internal stiffening rib is in an area diametrically opposed from said ratchet fingers.

* * * * *